US012595707B2

(12) United States Patent
Chavan

(10) Patent No.: US 12,595,707 B2
(45) Date of Patent: Apr. 7, 2026

(54) SUB-ASSEMBLY, ROCK DRILLING RIG, AND METHOD OF ABSORBING VIBRATIONS IN DRILLING

(71) Applicant: SANDVIK MINING AND CONSTRUCTION TOOLS AB, Sandviken (SE)

(72) Inventor: Vitthal Chavan, Sandviken (SE)

(73) Assignee: Sandvik Mining and Construction Tools AB, Sandviken (SE)

( * ) Notice: Subject to any disclaimer, the term of this patent is extended or adjusted under 35 U.S.C. 154(b) by 16 days.

(21) Appl. No.: 18/714,723

(22) PCT Filed: Dec. 2, 2022

(86) PCT No.: PCT/IN2022/051051
§ 371 (c)(1),
(2) Date: May 30, 2024

(87) PCT Pub. No.: WO2023/100198
PCT Pub. Date: Jun. 8, 2023

(65) Prior Publication Data

US 2025/0027373 A1 Jan. 23, 2025

(30) Foreign Application Priority Data

Dec. 3, 2021 (IN) ..... 202121056140

(51) Int. Cl.
*E21B 17/03* (2006.01)
*E21B 17/07* (2006.01)

(52) U.S. Cl.
CPC ..... *E21B 17/073* (2013.01); *E21B 17/076* (2013.01)

(58) Field of Classification Search
CPC ..... E21B 17/07; E21B 17/073; E21B 17/076; E21B 3/02; E21B 3/022; E21B 17/03; F16D 3/06
See application file for complete search history.

(56) References Cited

U.S. PATENT DOCUMENTS 3,746,330 A * 7/1973 Taciuk ..... F16F 15/1442 464/95
3,947,009 A * 3/1976 Nelmark ..... E21B 17/073 175/320
4,759,738 A * 7/1988 Johnson ..... E21B 17/07 175/321
5,632,335 A * 5/1997 Campbell ..... E21B 17/1064 166/242.6

(Continued)

FOREIGN PATENT DOCUMENTS

CA 2638497 A1 2/2010

*Primary Examiner* — Kipp C Wallace
(74) *Attorney, Agent, or Firm* — Corinne R. Gorski

(57) ABSTRACT

A sub-assembly, rock drilling rig and method of absorbing vibrations in rotary and DTH drilling. The sub-assembly is for transmitting torque and axial forces between a rotating head and a drilling tool. There is an axial floating arrangement for providing an allowed limited axial relative movement between coupling elements of the sub-assembly. The arrangement comprises several axial drive pins for transmitting the torque. First ends of the drive pins are mounted immovably and second ends are mounted with clearances, whereby the drive pins can bend under torsional shocks. Thus, the drive pins serve as torsional dampening elements.

17 Claims, 6 Drawing Sheets

(56) References Cited

U.S. PATENT DOCUMENTS

| | | | | |
|---|---|---|---|---|
| 6,332,841 | B1 * | 12/2001 | Secord | E21B 17/073 175/321 |
| 2009/0101412 | A1 * | 4/2009 | Hartung | E21B 17/07 175/56 |
| 2010/0025118 | A1 * | 2/2010 | Hampson | E21B 17/07 175/321 |
| 2010/0263934 | A1 * | 10/2010 | Nielsen | E21B 17/07 175/113 |
| 2011/0294583 | A1 * | 12/2011 | Hocking | E21B 17/07 464/18 |

* cited by examiner

SUB-ASSEMBLY, ROCK DRILLING RIG, AND METHOD OF ABSORBING VIBRATIONS IN DRILLING

RELATED APPLICATION DATA

This application is a § 371 National Stage Application of PCT International Application No. PCT/IN2022051051 filed Dec. 2, 2022 with priority to IN 202121056140 filed Dec. 3, 2021.

TECHNICAL FIELD OF THE INVENTION

The invention relates to a sub-assembly for rotary and DTH drilling of rock material.

The invention further relates to a rock drilling rig and method of absorbing vibrations in drilling. The field of the invention is defined more specifically in the preambles of the independent claims.

BACKGROUND OF THE INVENTION

In mines and at other work sites different type of rock drilling rigs are used for drilling drill holes to rock surfaces. In rotary drilling and DTH drilling sub-assemblies are implemented between a rotation device and a drilling tool. The sub assembly is subjected to axial and torsional shocks during the drilling wherefore different constructional solutions for dampening the shocks are presented. However, the known solutions have shown some disadvantages, and especially relating durability of dampening components.

SUMMARY OF THE INVENTION

An object of the invention is to provide a novel and improved sub-assembly, rock drilling rig, and a method for absorbing vibrations in rotary drilling.

The sub-assembly according to the invention is characterized by the characterizing features of the first independent apparatus claim.

The rock drilling rig according to the invention is characterized by the characterizing features of the second independent apparatus claim.

The method according to the invention is characterized by the characterizing features of the independent method claim.

An idea of the disclosed solution is that a sub-assembly, which is configured to transmit torque and axial forces between a rotating head and a drilling tool, comprises an axial floating arrangement for providing an allowed limited axial relative movement between a first coupling element and a second coupling element. The axial floating arrangement comprises several axial drive pins for transmitting the torque. First ends the mentioned drive pins are mounted immovably and second ends are mounted with clearances. Then the drive pins can bend in relation to their first ends under torsional shocks. The drive pins serve as torsional dampening elements and can absorb torsional shocks. In other words, each of the drive pins have the first end with fixed mounting and the second end with loose mounting, whereby the drive pins are subjected to cantilever bending when the sub-assembly is subjected to sudden changes in torsional forces. Thus, the drive pins are not only transmission elements but also part of the torsional cushion arrangement.

An advantage of the disclosed solution is that the drive pins serve as metallic pin-like torque dampeners which are durable and are service free. A further advantage is that the disclosed structure is relatively simple and inexpensive to manufacture.

Moreover, the disclosed sub-assembly can be implemented in a versatile manner in different rotation heads and rock drilling units.

According to an embodiment, the sub-assembly may alternatively be called as a shock sub, a shock absorber, a floating spindle, or a floating cushion sub.

According to an embodiment, magnitudes of the clearances at the second ends of the drive pins are dependent on the structural design and magnitudes of the torsional forces being transmitted.

According to an embodiment, the drive pins serve as metallic spring elements. In other words, the drive pins may operate as a kind of spring dampeners or metallic bendable transmission elements.

According to an embodiment, the drive pins are made of spring steel. In other words, the material of the drive pins is selected in respect to the intended use as a bendable machine element. The spring steel is durable against permanent bending and thereby tolerates well repetitive loadings without being permanently deformed. Typically, the spring steel is known as an alloy that can withstand intense twisting and bending without becoming distorted. The spring steel is resilient and pliable, yet durable, which is perfect for this particular use in the drive pins. The drive pins made of spring steel can be bent and yet they will return to their original shape. This characteristic is commonly known as high yield strength.

According to an embodiment, the torque is configured to be transmitted between the drive pins and the second coupling element directly by means of their contact surfaces. In other words, there is metal to metal contact without separate dampening elements between the drive pins and the second coupling element. This is advantageous for the durability of the structure.

According to an embodiment, number of the drive pins is at least two.

According to an embodiment, number of the drive pins is 8-12.

According to an embodiment, the implemented several drive pins are spaced evenly around the central fluid passageway.

According to an embodiment, the second end portions of the drive pins are provided with cushion rings surrounding the drive pins for assisting the dampening. In other words, the drive pins and the cushion rings can operate together for dampening torque shocks. The cushion rings may dampen torque shocks with lower magnitude. Further, the cushion rings may support the free ends of the drive pins and may thereby prevent possible oscillation of the drive pins and may thus operate together with the drive pins when absorbing vibrations.

According to an embodiment, the cushion rings may be made of resilient cushion material. The resilient cushion material may be suitable polymer material or rubber-type material, for example.

According to an embodiment, the resilient cushion material of the cushion rings may be polyurethane. Polyurethane is durable material, and it has good dampening properties.

According to an embodiment, the axial dampening arrangement comprises a ring-shaped top pad and a ring-shaped bottom pad. The mentioned top and bottom pads are made of polyurethane material.

According to an embodiment, the top and bottom pad of the axial dampening arrangement are alternatively made of rubber-type material, or any other suitable resilient cushion material. One possible material may also be polytetrafluoroethylene (PTFE).

According to an embodiment, the first coupling element comprises a first cover element provided with a protruding adapter pin and a second cover element at an axial distance from the first cover element. A housing element with cylinder-like configuration is arranged between the first cover element and the second cover element for providing a floating space, or float space, for the axial floating arrangement. The second coupling element comprises an adapter housing for receiving a coupling end of the drilling tool and protruding into an opposite direction relative to the adapter pin. The second coupling element further comprises a stem which is arranged inside the housing element and can slide axially inside the floating space. The first cover element is provided with several first blind openings for receiving the first ends of the drive pins. The second cover element is provided several second blind openings for receiving the second ends of the drive pins, whereby the drive pins are mounted between the first and second blind openings. The stem comprises several through openings at the drive pins whereby the drive pins penetrate axially through the stem. A ring-shaped top pad, which is provided with a central opening for the fluid passageway and several radial openings for the drive pins, is located inside the floating space at a side of the first coupling end. And a ring-shaped bottom pad, provided with a central opening for a stem part of the second coupling end and several radial openings for the drive pins, is located inside the floating space at a side of the second coupling end. The axial fluid passageway is a sleeve-like element, or a tube, a first end of which is mounted immovably to the first connecting element and a second end portion is connected slidingly to the second connecting element. Further, the mentioned first blind openings of the first cover element and the first ends of the drive pins have tight fit connections, whereas the second blind openings of the second cover element and the second ends of the drive pins have clearance fit connections.

According to an embodiment, the mentioned second blind openings of the second cover element are provided with cushion space portions provided with cushion rings made of resilient material. In other words, the second blind openings comprise the cushion space portions at their top parts and clearance space portions at their bottom parts.

According to an embodiment, the second ends of the drive pins are provided with separate resilient cushion elements for dampening movements of the second ends. The cushion elements may have ring-shaped configuration or any other shape. A further alternative is to cover the second ends of the drive pins with a layer of resilient material. The resilient material may be polyurethane or rubber-type material. One possible material may also be polytetrafluoroethylene (PTFE).

According to an embodiment, magnitude of the mentioned clearance is 1-3 mm.

According to an embodiment, diameter of the drive pin is 25-42 mm.

According to an embodiment, magnitude of the mentioned clearance is 1 mm and diameter of the drive pin is 35 mm or 42 mm.

According to an embodiment, the disclosed solution relates also to a rock drilling rig for drilling drill holes to a rock surface. The rock drilling rig comprises: a movable carrier; at least one drilling mast; a drilling unit comprising a feed device for moving the drilling unit on the drilling mast in a drilling direction and return direction, and a rotating head for rotating a drilling tool around its longitudinal axis; a sub-assembly coupled between the rotating head and the drilling tool for transmitting axial forces and torque between the rotating head and the drilling tool, and wherein the sub-assembly is configured to allow axial floating between the rotating head and the drilling tool and to absorb axial and torsional shocks. Further, the sub-assembly is in accordance with the features and embodiments disclosed in this document.

According to an embodiment, the rock drilling rig is intended for rotary drilling. In the rotary drilling no impact devices are utilized in rock breaking.

According to an embodiment, the rock drilling rig is intended for down-the-hole drilling (DTH). In the DTH drilling a drill bit end of a rotated drilling tool is provided with an impact device, i.e., the impact device is located at a bottom of the drill hole during the drilling.

According to an embodiment, the drilling mast may be substituted by an articulated drilling boom provided with a feed beam.

According to an embodiment, the disclosed solution relates to a method of absorbing vibrations in rotary drilling. The method comprises: rotating a drilling tool around its longitudinal axis by means of a rotating device; providing a sub-assembly between the rotating device and the drilling tool for allowing axial floating movement between the rotating device and the drilling tool and for transmitting axial forces and torque; transmitting the torque by means of several axial drive pins of the sub-assembly; absorbing axial shocks by means of an axial dampening arrangement of the sub-assembly comprising axial cushion elements; and absorbing torsional shocks by means of a torsional dampening arrangement of the sub-assembly. The method further comprises implementing the drive pins as elements of the torsional dampening arrangement and providing the drive pins cantilever type configuration by mounting their first ends immovably and allowing their opposite second ends to move in transverse direction when torsional shocks are subjected to the sub-assembly. Then the drive pins can bend when subjected to the torsional shocks and absorbing torsional vibrations by material properties of the drive pins. In other words, torsional forces are transmitted through the sub-assembly by means of bendable metallic machine elements which provide shock absorption for the drilling system.

According to an embodiment, the method comprises transmitting the torque forces in the sub-assembly through metal to metal contacting surfaces.

According to an embodiment, the method comprises providing the mountings of the second ends of the drive pins with clearances.

According to an embodiment, the method comprises providing the mountings of the second end portions of the drive pins with dedicated dampening rings; and supporting the second ends of drive pins having loose mountings with the dampening rings and absorbing vibrations caused by the movements of the free second ends. In other words, the method comprises dampening torsional vibrations in the sub-assembly by a combined effect of the bending of the drive pins and radial compression of the dampening rings.

The above disclosed embodiments may be combined in order to form suitable solutions having those of the above features that are needed.

BRIEF DESCRIPTION OF DRAWINGS

Some embodiments are described in more detail in the accompanying drawings, in which.

For the sake of clarity, the figures show some embodiments of the disclosed solution in a simplified manner. In the figures, like reference numerals identify like elements.

DETAILED DESCRIPTION OF PREFERRED EMBODIMENT OF THE INVENTION

Figure 1:
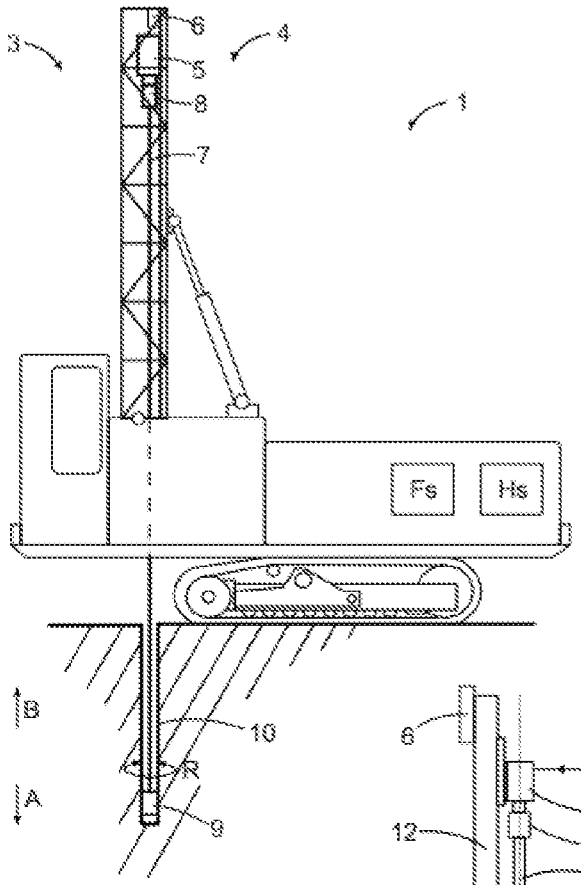
FIG. 1 is a schematic side view of a surface rock drilling rig intended for rotary drilling.

FIG. 1 shows a rock drilling rig 1 intended for surface drilling. The rock drilling rig 1 comprises a movable carrier 2 and at least one drilling mast 3 connected to the carrier 2. The mast 3 is provided with a drilling unit 4 provided with a rotating head 5 supported on the mast 3 and being movable in a drilling direction A and return direction B by means of a feed device 6. The rotating head 5 is connected to a drilling tool 7 by means of a sub-assembly 8. The drilling tool 7 is shown in a simplified manner for clarity reasons. The drilling tool 7 may comprise one or more tubular elongated elements and a drill bit 9 at its distal end. The rotating head 5 rotates R the drilling tool 7 around its longitudinal axis and the drilling tool 7 is simultaneously fed towards a rock surface being drilled. This is known as rotary drilling method. Drilling cuttings are flushed by feeding flushing fluid from a flushing system Fs via the drilling tool 7 to a drill hole 10 being drilled so that the drilling cuttings are flushed away from the drill hole 10. The drilling unit 4 may be hydraulic whereby it may be connected to a hydraulic system Hs.

Figure 2:
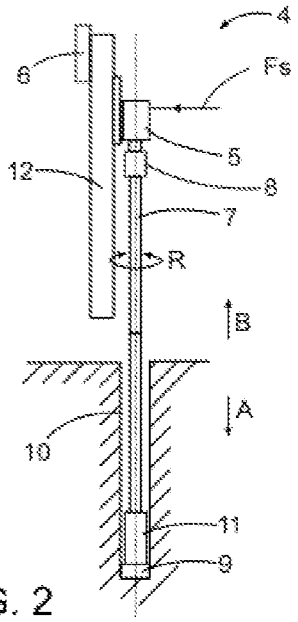
FIG. 2 is a schematic view of a rock drilling unit suitable for down-the-hole drilling.

FIG. 2 discloses another solution which differs from the one shown in FIG. 1 in that there is an impact device 11 mounted between a drill bit 9 and a drilling tool 7. The disclosed solution is intended for a down-the-hole drilling method, known also as DTH-drilling. Also, in this case a sub-assembly 8 is needed between a rotating head 5 and the drilling tool 7. A drilling unit 4 can be mounted movably on a feed beam 12, or in a similar manner as is shown in FIG. 1.

Figure 3:
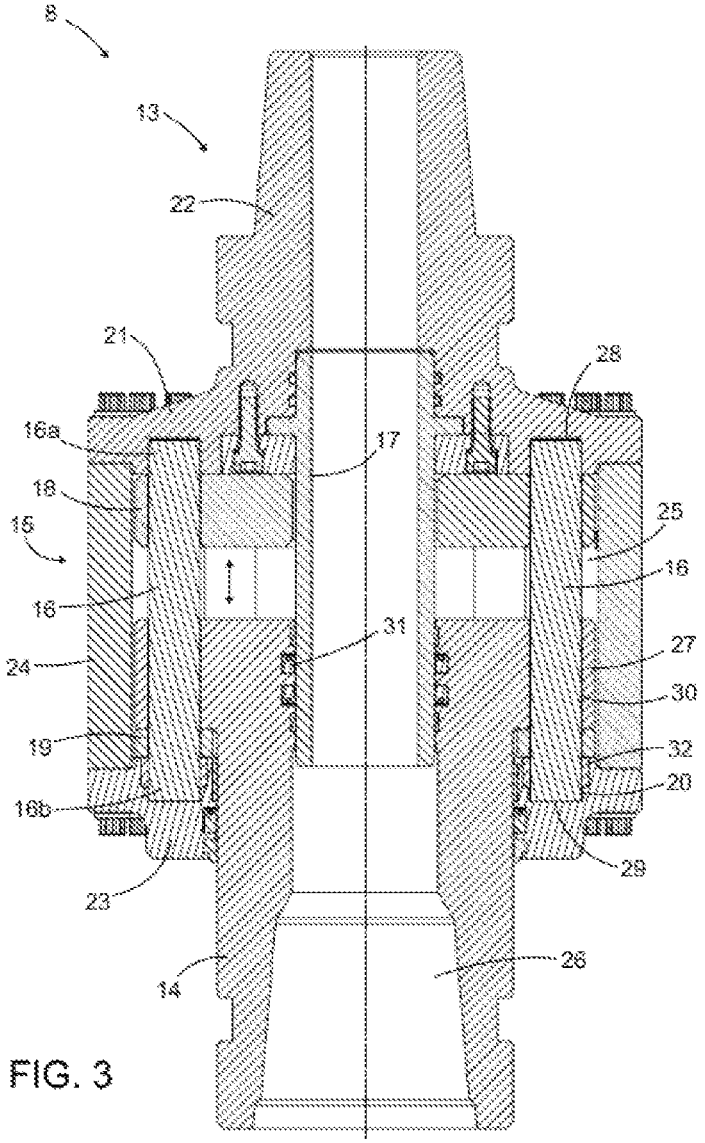
FIG. 3 is a schematic and cross-sectional side view of a sub-assembly.
Figure 4:
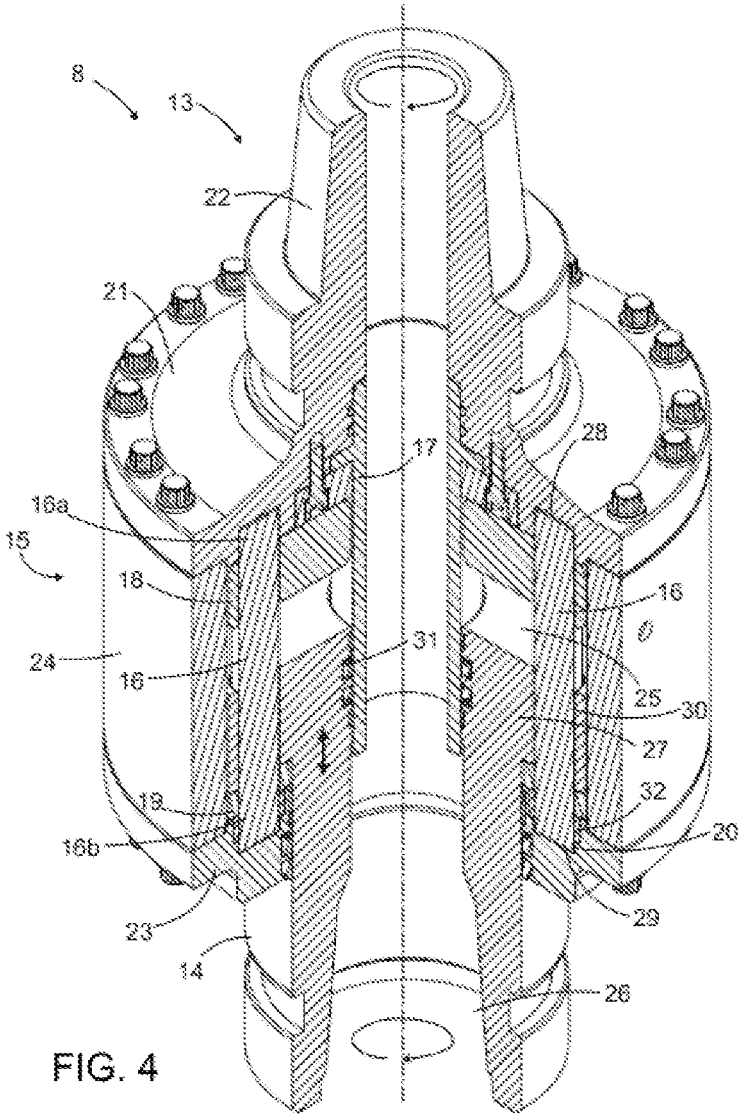
FIG. 4 is a schematic and partly cross-sectional views of the sub-assembly shown in FIG. 3.

FIGS. 3 and 4 disclose a sub-assembly 8 comprising a first coupling element 13 at a first end for coupling the sub-assembly 8 to the rotating head, and a second coupling element 14 at an opposite second end for coupling the sub-assembly 8 to the drilling tool. The sub-assembly is also provided with an axial floating arrangement 15 for providing an allowed limited axial relative movement between the first coupling element 13 and the second coupling element 14. The axial floating arrangement comprises several axial drive pins 16 for transmitting torque between the coupling elements 13, 14. There is an axial fluid passageway 17 passing centrally through the axial floating arrangement 15. The sub-assembly 8 comprises an axial dampening arrangement comprising at least one first end cushion element 18 and at least one second end cushion element 19 for dampening axial shocks at extreme axial positions of the axial floating arrangement 15.

Figure 5:
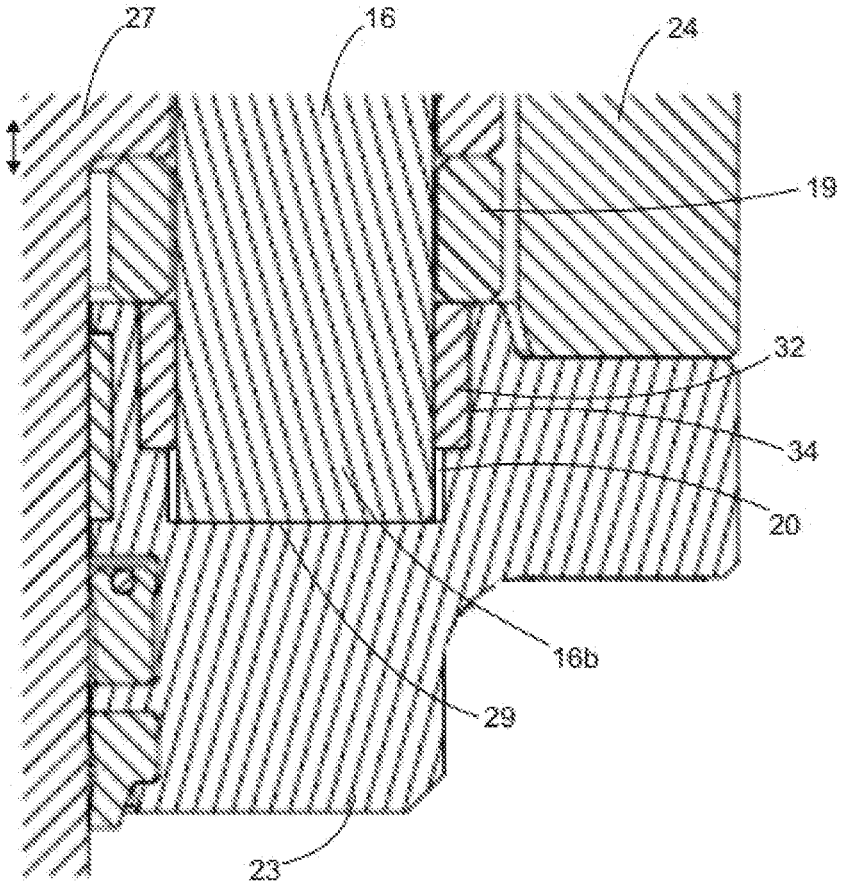
FIG. 5 is a schematic and cross-sectional view of a detail of a sub-assembly.

The mentioned drive pins 16 comprise first ends 16*a* mounted immovably and second ends 16*b* mounted with clearances 20, which are shown better in FIG. 5. The drive pins 16 are configured to be bent in relation to their first ends 16*a* under torsional shocks. The drive pins 16 serve as torsional dampening elements.

The first coupling element 13 comprises a first cover element 21 provided with a protruding adapter pin 22 and a second cover element 23 at an axial distance from the first cover element 21. A cylinder shaped housing element 24 is arranged between the first cover element 21 and the second cover 23 element for providing a floating space 25 for the axial floating arrangement 15.

The second coupling element 14 comprises an adapter housing 26 for receiving a coupling end of the drilling tool. The adapter housing 26 protrudes into an opposite direction relative to the adapter pin 22. Further, the second coupling element 14 comprises a stem 27 which is arranged inside the housing element 24 and can slide axially inside the floating space 25.

The first cover element 21 is provided with several first blind openings 28 for receiving the first ends 16*a* of the drive pins 16. The second cover element 23 is provided several second blind openings 29 for receiving the second ends 16*b* of the drive pins 16. Thereby, the drive pins 16 are mounted between the first and second blind openings 28, 29. The stem 27 comprises several through openings 30 through which the drive pins 16 penetrate axially.

The ring-shaped top pad 18 is provided with a central opening for the fluid passageway 17 and several radial openings for the drive pins 16, and it is located inside the floating space 25 at a side of the first coupling end 13. The ring-shaped bottom pad 19 is provided with a central opening for the stem part 27 of the second coupling end 14 and has several radial openings for the drive pins 16. The bottom pad 19 is located inside the floating space 25 at a side of the second coupling end 14. The axial fluid passageway 17 is a substantially sleeve-like element a first end of which is mounted immovably to the first connecting element 13 and a second end portion is connected slidingly to the second connecting element 14. The stem 27 can slide axially in relation to the tubular fluid passageway 17 and its sealings 31.

The mentioned first blind openings 28 of the first cover element 21 and the first ends 16*a* of the drive pins 16 have tight fit connections, whereas the second blind openings 29 of the second cover element 23 and the second ends 16*b* of the drive pins 16 have clearance fit connections. Further, the second end portions 16*b* are provided with cushion rings 32 surrounding the drive pins 16 and are thereby configured to assist the dampening.

FIG. 5 discloses the above mentioned clearance 20 and the cushion ring 32 in an enlarged view. The second blind openings 29 of the second cover element 23 are provided with cushion space portions 34 for receiving the cushion rings 32.

Figure 6:
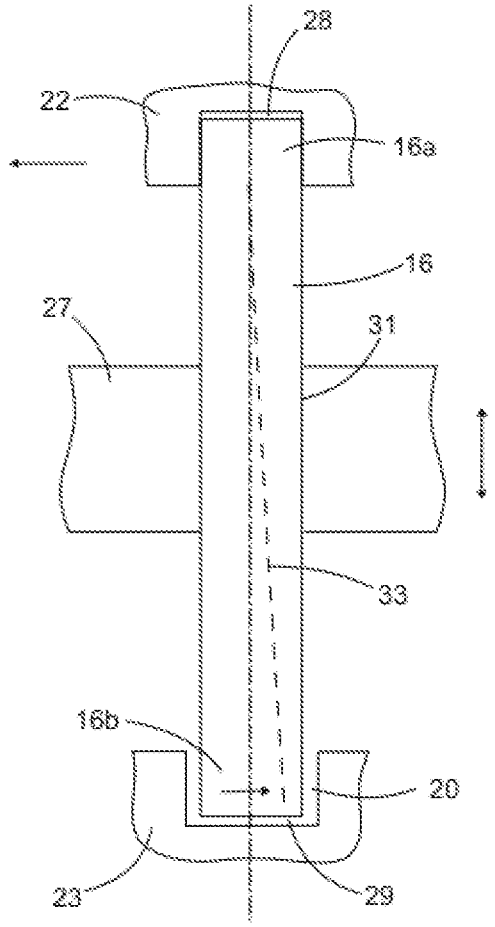
FIG. 6 is a simplified side view showing bending of drive pins of a sub-assembly.

FIG. 6 shows in a simplified manner bending 33 of disclosed cantilever supported drive pin 16. When the first cover 22 moves in left direction, the drive pin 16 follows that movement. Movement of the stem 27 is resisted since it is connected to the drilling tool. When sudden high forces occur i.e., the torque shocks exist, then the drive pin 16 bends 33 in a manner typical for a cantilever support, which is fixed at it one end. The cantilever support arrangement requires that the second end 16*b* of the drive pin 16 can move laterally and this is possible because of the clearance 20. In FIG. 6 there is no separate dampening ring at second end portion 16*b* of the drive pin 16, but it is possible to implement such dampening ring or any other resilient dampening element, dampening mass, or material therein if needed.

Figure 7:
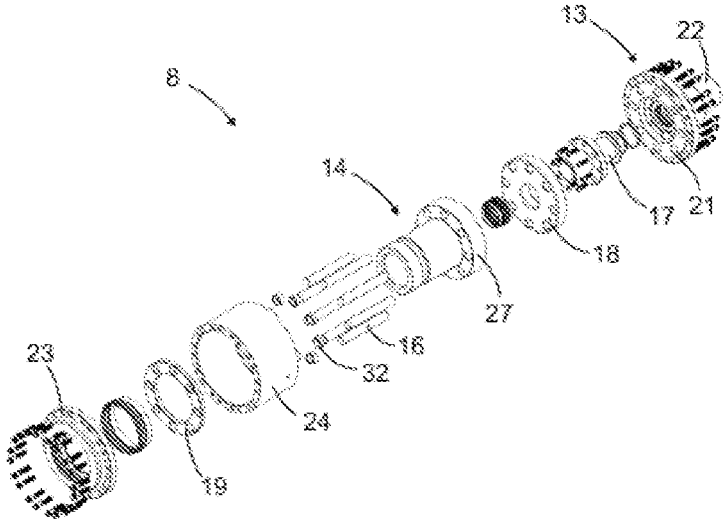
FIG. 7 is a schematic and exploded view of a sub-assembly and its components.

FIG. 7 shows some components of a sub-assembly 8. The structure of the sub-assembly 8 is in accordance with the FIGS. 3 and 4.

The drawings and the related description are only intended to illustrate the idea of the invention. In its details, the invention may vary within the scope of the claims.

I claim:

1. A sub-assembly for a rock drilling unit, wherein the sub-assembly is configured to transmit torque and axial forces between a rotating head and a drilling tool, the sub-assembly comprising:

a first coupling element located at a first end of the sub-assembly for coupling the sub-assembly to the rotating head, wherein the first coupling element includes a first cover element provided with a protruding adapter pin and a second cover element located at an axial distance from the first cover element, wherein a housing element having a cylinder-like configuration is arranged between the first cover element and the second cover element for providing a floating space for the axial floating arrangement, and;

a second coupling element located at an opposite, second end of the sub-assembly for coupling the sub-assembly to the drilling tool;

an axial floating arrangement for providing an allowed limited axial relative movement between the first coupling element and the second coupling element, the axial floating arrangement including a plurality of axial drive pins for transmitting the torque;

at least one axial fluid passageway passing centrally through the axial floating arrangement;

an axial dampening arrangement having at least one first end cushion element and at least one second end cushion element for dampening axial shocks at extreme axial positions of the axial floating arrangement; and a torsional dampening arrangement for absorbing torsional shocks, wherein the plurality of axial drive pins include first ends mounted immovably and second ends mounted with clearances, whereby the plurality of axial drive pins are configured to be bent in relation to the first ends under torsional shocks and the plurality of axial drive pins serve as torsional dampening elements of the torsional dampening arrangement, wherein the first cover element is provided with a plurality of first blind openings arranged for receiving the first ends of the plurality of axial drive pins, and the second cover element is provided with a plurality of second blind openings arranged for receiving the second ends of the plurality of axial drive pins, whereby the plurality of axial drive pins are mounted between the first and second blind openings, the first blind openings of the first cover element and the first ends of the plurality of axial drive pins having tight fit connections, whereas the second blind openings of the second cover element and the second ends of the plurality of axial drive pins have clearance fit connections.

2. The sub-assembly as claimed in claim 1, wherein the plurality of axial drive pins serve as metallic spring elements.

3. The sub-assembly as claimed in claim 1, wherein the plurality of axial drive pins are made of spring steel.

4. The sub-assembly as claimed in claim 1, wherein the torque is configured to be transmitted between the plurality of axial drive pins and the second coupling element directly by means of the contact surfaces.

5. The sub-assembly as claimed in claim 1, wherein a number of the plurality of axial drive pins is 8-12, the axial pins being spaced evenly around the central fluid passageway.

6. The sub-assembly as claimed in claim 1, wherein the second end portions are provided with cushion rings surrounding the plurality of axial drive pins for assisting dampening.

7. The sub-assembly as claimed in claim 1, wherein the first end cushion element is a ring-shaped top pad and the second end cushion element is a ring-shaped bottom pad, and wherein the top and bottom ring-shaped pads are made of a resilient cushion material.

8. The sub-assembly as claimed in claim 1, wherein the second blind openings of the second cover element are provided with cushion space portions provided with cushion rings made of a resilient material.

9. The sub-assembly as claimed in claim 8, wherein the resilient material is polyurethane.

10. The sub-assembly as claimed in claim 1, wherein a magnitude of the clearances is 1-3 mm.

11. A rock drilling rig for drilling drill holes to a rock surface, the rock drilling rig comprising:

a movable carrier;

at least one drilling mast;

a drilling unit including a feed device for moving the drilling unit on the drilling mast in a drilling direction and a return direction, and a rotating head for rotating a drilling tool around its longitudinal axis; and a sub-assembly as claimed in claim 1, the sub-assembly being coupled between the rotating head and the drilling tool for transmitting axial forces and torque between the rotating head and the drilling tool, and wherein the sub-assembly is configured to allow axial floating between the rotating head and the drilling tool and to absorb axial and torsional shocks.

12. A method of absorbing vibrations in rotary drilling, the method comprising:

rotating a drilling tool around its longitudinal axis by means of a rotating device;

providing a sub-assembly as claimed in claim 1 between the rotating device and the drilling tool for allowing axial floating movement between the rotating device and the drilling tool and for transmitting axial forces and torque;

transmitting the torque by means of a plurality of axial drive pins of the sub-assembly;

absorbing axial shocks by means of an axial dampening arrangement of the sub-assembly comprising axial cushion elements;

absorbing torsional shocks by means of a torsional dampening arrangement of the sub-assembly;

implementing the plurality of axial drive pins as elements of the torsional dampening arrangement;

providing the plurality of axial drive pins cantilever type configuration by mounting their first ends immovably and allowing their opposite second ends to move in transverse direction when torsional shocks are subjected to the sub-assembly; and and allowing the plurality of axial drive pins to bend when subjected to the torsional shocks and absorbing torsional vibrations by material properties of the plurality of axial drive pins.

13. The method as claimed in claim 12, further comprising providing the mountings of the second ends of the plurality of axial drive pins with clearances.

14. The method as claimed in claim 12, further comprising providing the mountings of the second end portions of the plurality of axial drive pins with dedicated dampening rings, and supporting the second ends of any axial drive pins having loose mountings with the dampening rings and absorbing vibrations caused by the movements of the free second ends.

15. The sub-assembly as claimed in claim 1, wherein the second coupling element includes an adapter housing arranged for receiving a coupling end of the drilling tool and protruding into an opposite direction relative to the adapter pin, and a stem, which is arranged inside the housing element and arranged to slide axially inside the floating space, and wherein the stem includes a plurality through openings at the plurality of axial drive pins, whereby the plurality of axial drive pins penetrate axially through the stem.

16. The sub-assembly as claimed in claim 1, wherein the first end cushion element is a ring-shaped top pad, the ring-shaped top pad including a central opening for the fluid passageway and a plurality of radial openings for the plurality of axial drive pins located inside the floating space at a side of the first coupling end, and wherein the second end cushion element is a ring-shaped bottom pad, the ring-shaped bottom pad including a central opening for the stem of the second coupling end and a plurality of radial openings for the plurality of axial drive pins and being located inside the floating space at a side of the second coupling end, wherein the top and bottom ring-shaped pads are made of a resilient cushion material.

17. The sub-assembly as claimed in claim 1, wherein the axial fluid passageway is a sleeve-like element having a first end which is mounted immovably to the first coupling element and a second end portion connected slidingly to the second coupling element.

* * * * *